US006186362B1

(12) United States Patent
Smith

(10) Patent No.: US 6,186,362 B1
(45) Date of Patent: Feb. 13, 2001

(54) EXTRACTOR FOR EMPTYING TUBES

(76) Inventor: Charles K. Smith, R.R.#1 Box 227A, Northumberland, PA (US) 17857

( * ) Notice: Under 35 U.S.C. 154(b), the term of this patent shall be extended for 0 days.

(21) Appl. No.: 09/411,851

(22) Filed: Oct. 4, 1999

(51) Int. Cl.[7] ..... B65D 35/28
(52) U.S. Cl. ..... 222/102
(58) Field of Search ..... 222/102; 251/6

(56) References Cited

U.S. PATENT DOCUMENTS

| | | | |
|---|---|---|---|
| 1,773,104 | 8/1930 | Johnson . | |
| 1,983,462 | 12/1934 | Johnson . | |
| 5,131,567 | 7/1992 | Lipsey . | |
| 5,167,348 | 12/1992 | Okami et al. . | |
| 5,277,335 * | 1/1994 | Okani et al. | 222/102 |
| 5,372,282 | 12/1994 | Barchus . | |

FOREIGN PATENT DOCUMENTS

| | | |
|---|---|---|
| 466853 | 9/1928 | (DE) . |
| 830828 | 1/1952 | (DE) . |
| 444344 | 1/1949 | (IT) . |
| 452153 | 10/1949 | (IT) . |
| 620967 | 5/1961 | (IT) . |

* cited by examiner

*Primary Examiner*—Philippe Derakshani
(74) *Attorney, Agent, or Firm*—William H. Eilberg

(57) ABSTRACT

An extractor neatly and cleanly empties a tube of toothpaste, or the like. The extractor includes a pair of roller assemblies and a pair of end caps. Each roller assembly has a pair of balls which fit within sockets formed in the end caps. In one embodiment, the balls have slits to enable sections of the balls to move towards and away from each other. The balls are made of resilient material, such that the sections tend to assume a spaced-apart position in the absence of an applied compressive force. As the ball is urged into the socket, the sections of the ball become compressed, thus enabling the ball to pass through a hole in the end cap and into the socket. When the ball has reached its socket, the sections return to their initial position, so as to lock the ball within the socket. In an alternative embodiment, the ball is not compressible, but is instead inserted into a deformable socket having resiliently movable walls which lock around the ball. With either embodiment, the extractor can therefore be assembled and dis-assembled quickly and easily, and can be removed from a used tube and installed quickly on a new tube.

19 Claims, 6 Drawing Sheets

EXTRACTOR FOR EMPTYING TUBES

BACKGROUND OF THE INVENTION

The present invention provides a device which conveniently extracts material from a tube. The invention is especially intended to remove extrudable substances such as toothpaste, ointments, creams, and the like, from the tubes in which such materials are packaged.

Toothpaste tubes and the like present the perennial problem of how to extract the contents of the tube cleanly and evenly, and without unduly distorting the tube or wasting its contents. One known solution is to roll the tube gradually, by hand, as the contents are used. This solution, while an improvement over randomly squeezing the tube by hand, is inconvenient, and, unless the operation is performed flawlessly, will usually result in waste of some of the material in the tube.

It has therefore been proposed to provide a pair of rollers, disposed on either side of the tube, wherein the rollers bear upon the tube and cause its contents to move upward, towards the opening. This solution achieves essentially the same result as rolling the tube by hand, but it has the advantage that the rolling is more mechanized. However, a practical means of implementing a roller-based device has not been shown in the prior art. The roller devices proposed in the past are too mechanically complex to be manufactured inexpensively and used conveniently. They are not easily attached to, and removed from, the tube.

The present invention solves the problems described above, by providing a device which comprises a pair of rollers which fit around a tube of material, but which can easily be removed and re-attached to the tube. The latter feature enables the device to be used on one tube until the contents are spent, and then to be transferred quickly to a new tube. The extractor of the present invention can squeeze virtually any material from a tube, including toothpaste, medicines, ointments, creams, hair colorings, and other substances.

SUMMARY OF THE INVENTION

The extractor of the present invention includes four parts, namely two roller assemblies and two end caps. Each roller assembly includes a roller and two pairs of truncated balls, the balls being held to the roller by a neck. The balls are inserted in sockets defined by the end caps.

In one embodiment, the balls have slits which effectively divide each ball into two sections. The slits are constructed so that the sections of the ball can move towards and away from each other. The balls are made of a resilient material, so that, in the absence of an external compressive force, the sections tend to assume a spaced-apart position.

Each slit has a length which is greater than the implied radius of the ball, thereby allowing the sections of the ball to move back and forth without cracking. As the ball is inserted into the socket, through a chamfered section which guides the ball, the sections are compressed, and move together, thereby allowing the ball to be inserted fully into the socket. When each ball is fully inserted in its socket, there is no longer any compressive force acting on the ball, and the sections return to their normal position. The effect is to lock each ball within its socket. Nevertheless, it is still relatively easy to pull the ball and socket apart, without tools, because pulling the ball urges the sections against the interior wall of the socket, thereby pushing the sections of the ball together, and making it easy to move the ball through the end cap.

In another embodiment, the balls are not compressible, but the sockets instead have walls which resiliently deform when a ball is inserted. The result is the same as in the first embodiment. In both embodiments, the end caps are resiliently locked onto the balls.

Having only four separate parts, the extractor is easy to assemble and dis-assemble. It can be assembled first, and then advanced onto a tube, or it can be assembled in position on the tube, and then advanced. Movement of the extractor along the tube is accomplished by hand rotation of the rollers. The balls and sockets act as bearings for the rollers as they turn.

The extractor of the present invention insures that virtually all of the material in a tube will be used, and that the tube will remain neat and clean while in use. When the tube is empty, the extractor can be easily removed from the old tube and re-installed on a new tube.

The present invention therefore has the primary object of providing an extractor for emptying the contents of a tube of material.

The invention has the further object of maintaining a tube of material in a neat and clean condition while its contents are gradually removed.

The invention has the further object of providing an extractor for emptying the contents of a tube, in which a pair of rollers are conveniently journalled within sockets of an end piece.

The invention has the further object of providing an extractor for emptying a tube, wherein the extractor has only four parts, and wherein the extractor can be quickly and easily assembled and dis-assembled.

The invention has the further object of providing an extractor for a tube, the extractor having rollers which connect to end caps with ball and socket joints, and wherein the ball and socket includes means for facilitating entry of the ball into the socket.

The reader skilled in the art will recognize other objects and advantages of the present invention, from a reading of the following brief description of the drawings, the detailed description of the invention, and the appended claims.

DETAILED DESCRIPTION OF THE INVENTION

Figure 1A:
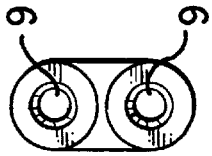
FIG. 1*a* provides an end view of the extractor of the present invention.
Figure 2A:
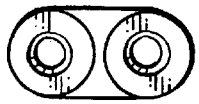
FIG. 2*a* provides an end view of the extractor of FIG. 2.
Figure 1:
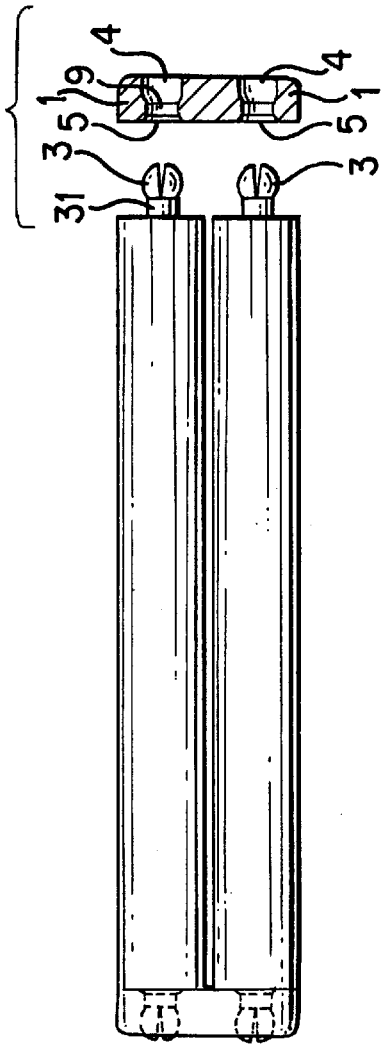
FIG. 1 provides an exploded side view of the extractor of the present invention, showing one of the end caps separated from the rollers.
Figure 2:
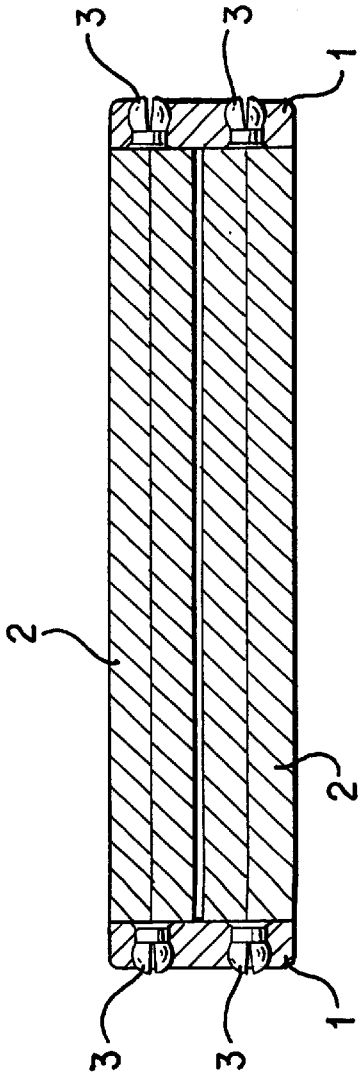
FIG. 2 provides a side view showing a fully assembled extractor of the present invention.
Figure 3:
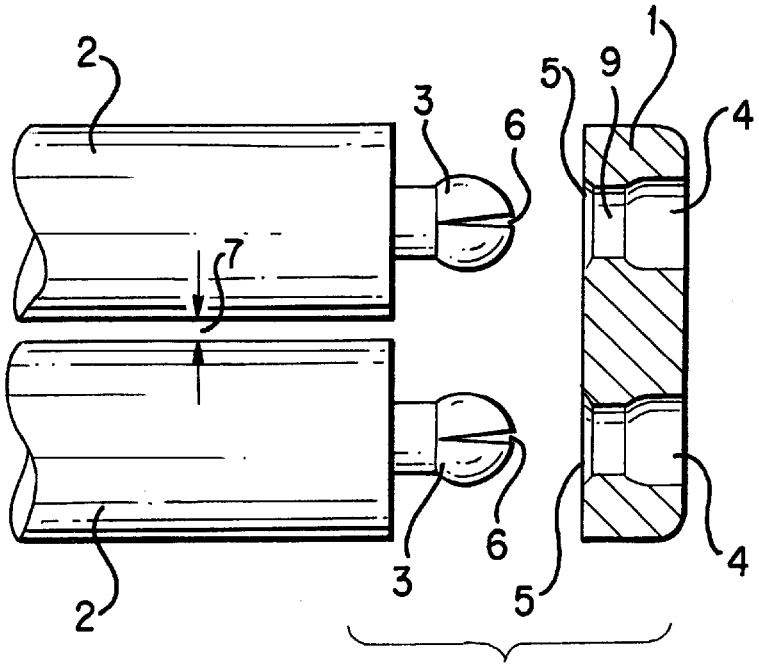
FIG. 3 provides an enlarged side view of the extractor of the present invention, showing the rollers separated from an end cap.
Figure 3A:
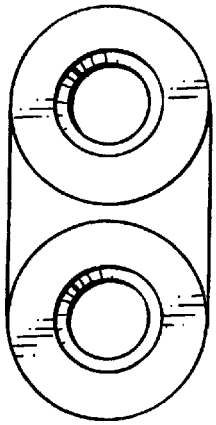
FIG. 3*a* provides an end view of the extractor of FIG. 3.

As shown in FIGS. 1–3, the extractor of the present invention includes a pair of roller assemblies. Each roller assembly includes a roller 2 and a pair of balls 3, the balls being attached to the roller at each end. A neck 31 joins each ball to its respective roller. Each ball is truncated by the neck to which it is attached, and thus the ball does not comprise a complete sphere.

The balls 3 are seated within sockets 4 formed in end caps 1. The end caps are constructed such that the balls can be easily snapped into, and removed from, the sockets. Each socket includes chamfer 5 which guides the ball as it enters the hole 9 of the socket. As the ball moves from left to right, as shown in FIGS. 1–3, the shape of the chamfer is such as to compress the ball gradually.

The socket 4, hole 9, and chamfer 5 together define a shape which generally mates with the ball and its neck. In the preferred embodiment, the socket is slightly larger than the ball, thereby allowing the ball to turn freely in the socket. FIG. 1 shows the extractor with the one of the end caps removed; FIG. 2 shows the extractor with both end caps installed.

The extractor of the present invention therefore comprises four parts, namely the two roller assemblies and the two end caps.

The balls are preferably constructed of a material such as plastic, which can be injection molded by conventional methods. The invention is not limited to a particular material. The major consideration in choosing a material is its resiliency. It is important, for reasons that will become apparent below, that the material be sufficiently resilient that it can be distorted from an initial position, without cracking, and that it will return to its initial position when an applied force is removed.

FIG. 3 provides an enlarged, partial side view of the roller assemblies and one of the end caps. As shown in FIG. 3, the balls include angled or tapered slits 6. The equilibrium positions of the balls are as shown in the figures. In this equilibrium position, the taper of the slit is such that the slit is wider near the outer portion of the ball, and narrower as one moves towards the roller. In other words, the width of the slit increases with distance from the roller. In effect, the slits appear slightly opened, and the two segments of each ball are slightly spaced apart, in the equilibrium position, as shown.

When the segments of the ball are compressed together, such as when the ball is urged into the socket, the taper of the slit becomes less pronounced, as the width of the slit near the surface of the ball decreases. When the segments of the ball have been compressed as far as possible, the segments are essentially adjacent to each other, and the slit essentially vanishes. Then, after the ball has been inserted into the socket, the force of compression is reduced or removed, due to the larger size of the socket which allows the segments to relax and return to their original positions. This means that the ball will fill nearly all the space in the socket, thus firmly locking the roller to the end cap.

To remove the ball from the socket, one simply pulls the roller away from the end cap. This pulling force urges the ball towards the hole 9. The internal walls of hole 9 act as cams which compress the sections of the ball and urge them together, thus allowing the ball to slide through the hole.

The sockets in the end caps are positioned such that, when the extractor is assembled, the rollers will be spaced apart by a predetermined distance. In FIG. 3, this distance is indicated by gap 7. The size of the gap depends on the tube with which the extractor is to be used. In making the extractor of the present invention, it is therefore preferable first to measure the thickness of the tube to be emptied, and then to construct the end caps to define a gap appropriate to this thickness.

In the preferred embodiment, the rollers should substantially traverse the width of the tube to be emptied. Thus, in constructing the extractor, it is desirable to measure the width of the tube with which the extractor will be used, and to make the rollers slightly longer than the width of the tube. In a preferred embodiment, the length of the rollers may be about ⅛ inch greater than the width of the tube, as measured from the inside of one end cap to the inside of the other end cap. The latter figure may be varied, and the invention is not limited by the choice of this dimension.

Figure 4:
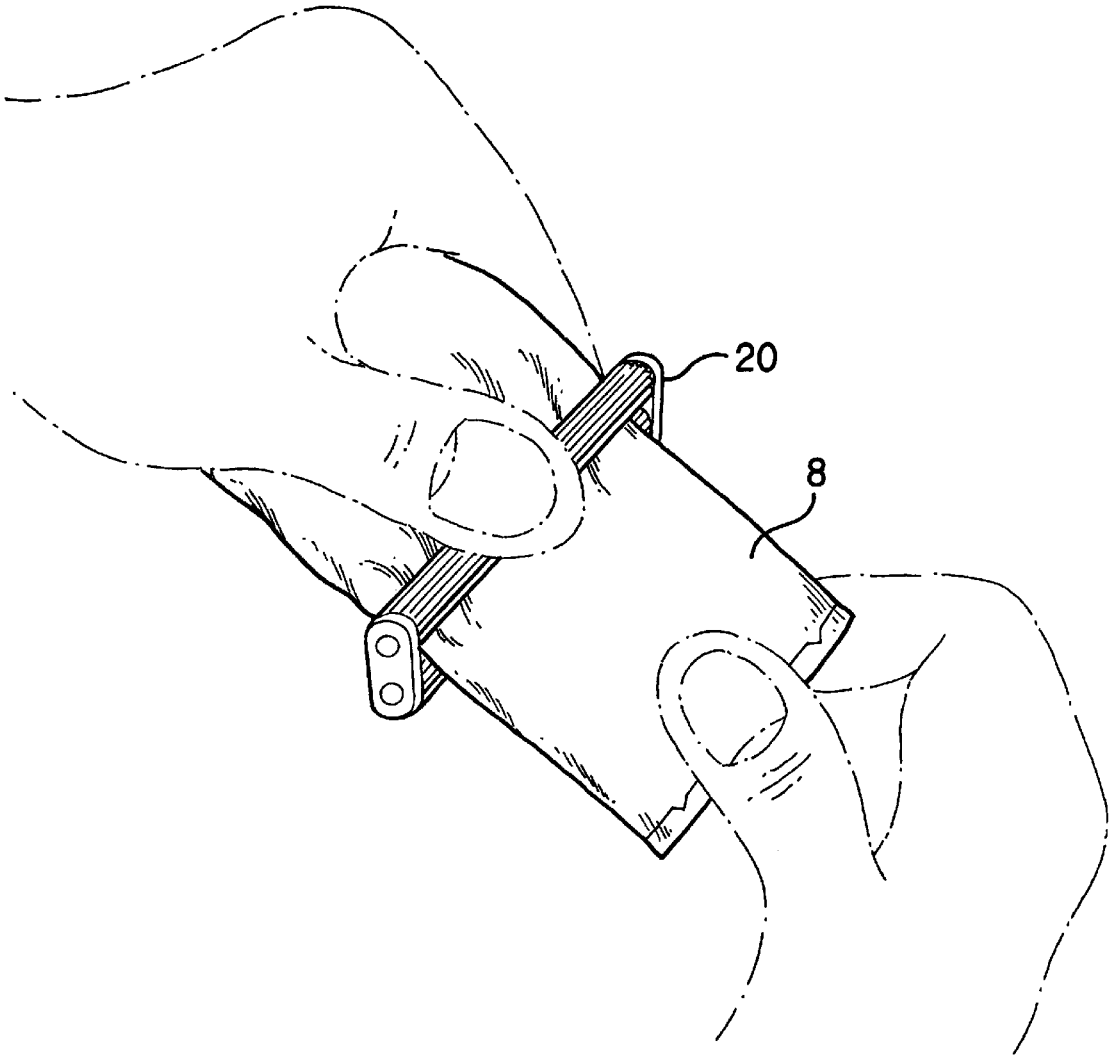
FIG. 4 provides a perspective view of the extractor of the present invention, as used in emptying the contents of a tube.

FIG. 4 provides a perspective view showing the use of the present invention. Extractor 20 is shown installed around tube 8. In actual use, the extractor may be first fully assembled, and then attached onto the flat bottom edge of a tube. The rollers are turned by the fingers of one hand, while the other hand holds the bottom edge of the tube.

Alternatively, the extractor could be assembled after the roller assemblies have been arranged around the tube. One could hold the roller assemblies, with the tube between them, with one hand, and could use the other hand to snap the end caps onto the balls.

In another alternative, one may first partially assemble the extractor, before arranging it around the tube, by attaching one end cap to the pair of roller assemblies. Then, one would fit the rollers around the tube, and secure the extractor over the tube by attaching the other end cap.

In all cases, the attachment of the end cap is performed simply by snapping the rollers into the sockets of the end caps. After installation, one or both of the rollers are turned by hand, such as by using the fingers to manipulate the rollers as shown. The extractor therefore holds material in the upper half of the tube, while squeezing out virtually all material in the lower half. As the rollers are turned, the balls and sockets act as bearings, allowing the rollers to turn freely as they are advanced along the tube.

Figure 5:
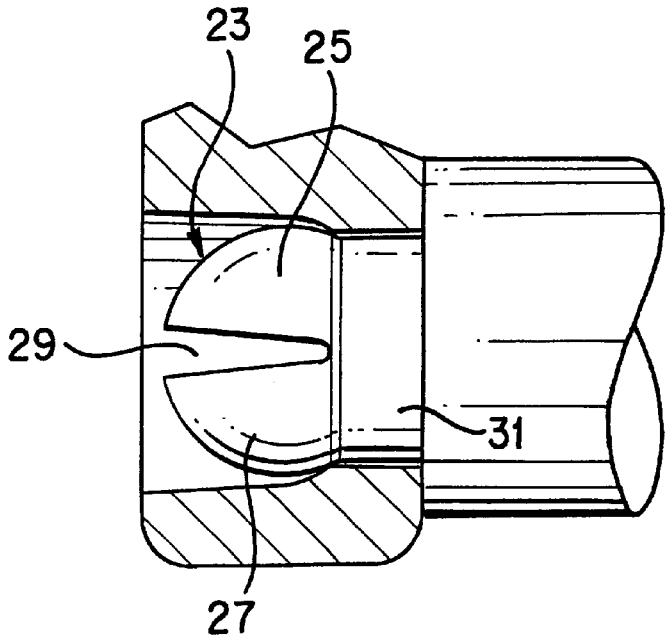
FIG. 5 provides a detail, in side elevation, of a ball attached to one of the rollers of the extractor of the present invention.
Figure 6:
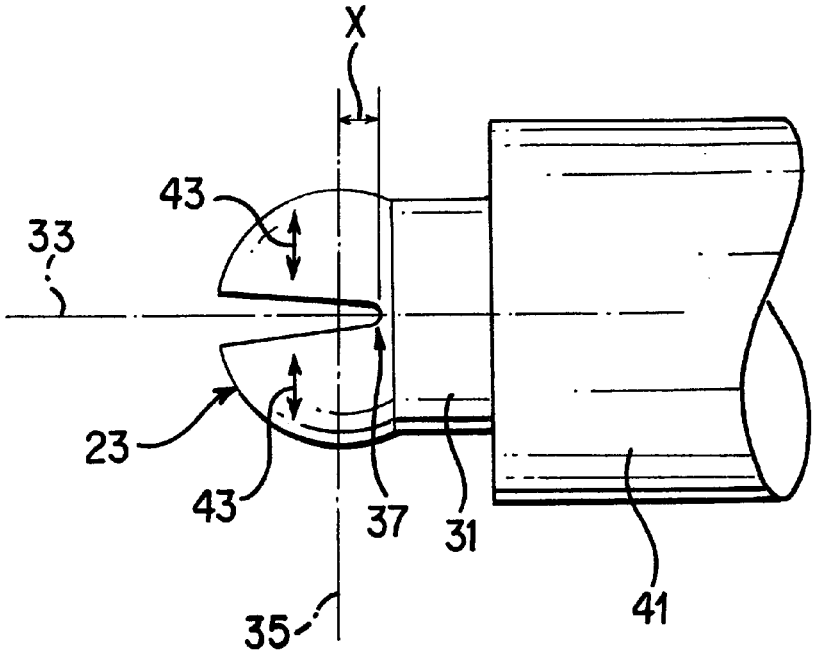
FIG. 6 provides another detail, in side elevation, of a ball and roller, illustrating various geometrical relationships of the present invention.

FIGS. 5 and 6 provide further details of the geometry of the balls. FIG. 5 shows one of the balls inserted into a corresponding socket. As shown in FIG. 5, ball 23 comprises an upper section 25 and a lower section 27. These two sections together define the truncated sphere described above. The two sections are mounted on the neck 31, which is attached to the roller. As shown in FIG. 5, the slit extends beyond the center of the ball, in a direction towards the roller. Thus, the slit has a length which is greater than the radius of the ball, the radius being defined as the radius of the sphere that is implied by the ball. The structure of the slit is more clearly illustrated in FIG. 6.

FIG. 6 shows center line 35 of the ball. This center line passes through the geometric center of the ball, as if the ball were complete and not truncated. FIG. 6 also shows the relationship of the ball to the longitudinal axis 33 of the roller 41. As indicated by FIG. 6, the apex 37 of the slit is located a distance x from the center line 35. Moreover, the apex 37 is curved, having a predetermined radius of curvature. The radius of curvature is chosen to be large enough to enable the upper and lower sections of the ball to flex together and apart without cracking. Arrows 43 show the directions of movement of the sections of the ball when the sections are compressed and released.

Figure 7A:
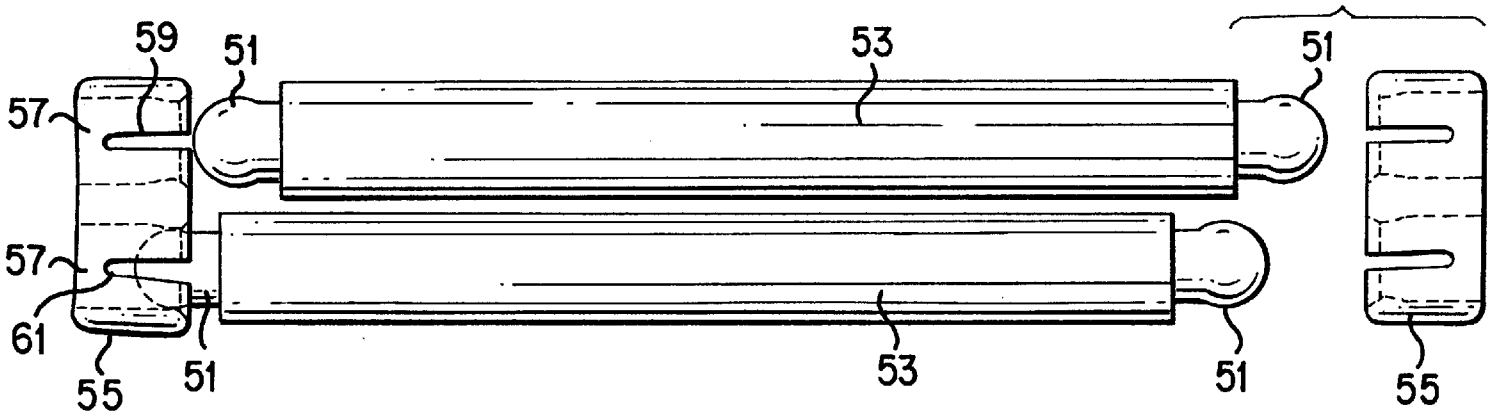
FIG. 7*a* provides a side elevational view of another embodiment of the invention, in which a ball snaps into a deformable socket.
Figure 7B:
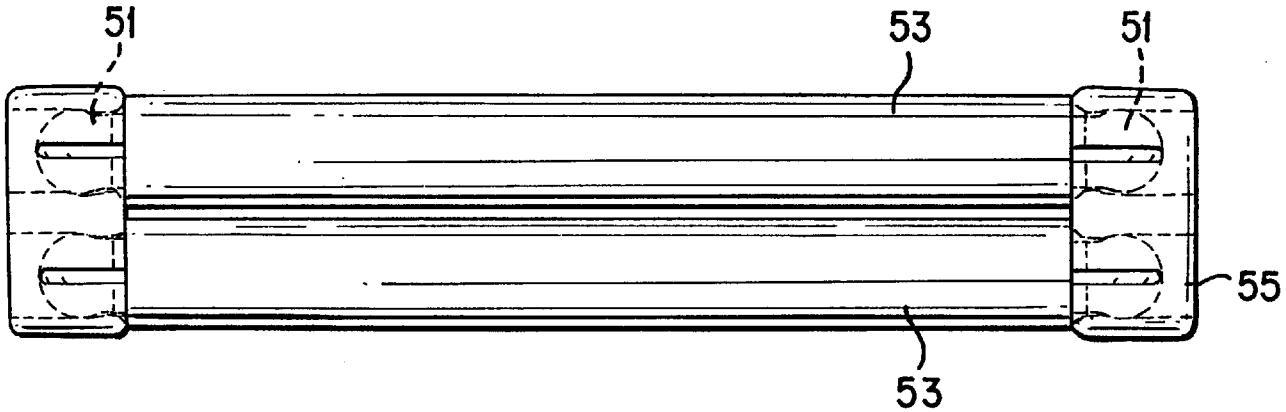
FIG. 7*b* provides a side elevational view of the embodiment of FIG. 7*a*, showing all four balls inserted into the corresponding sockets.
Figure 7C:
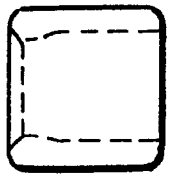
FIGS. 7*c*, 7*d*, and 7*e* provide top, inside, and side views of the socket made according to the embodiment of FIGS. 7*a* and 7*b*.
Figure 7D:
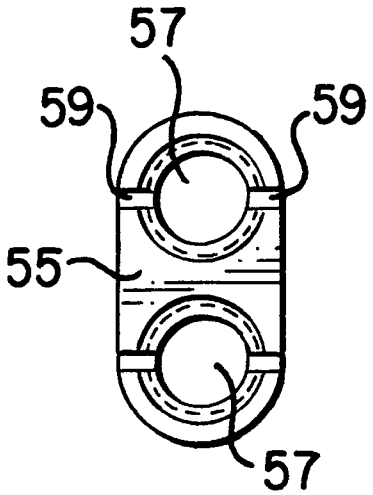
Figure 7E:
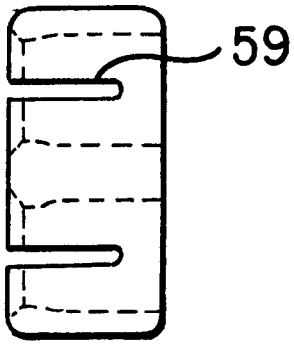

FIGS. 7*a*–7*e* illustrate another embodiment of the invention, in which the balls are not compressible, but are instead inserted into deformable sockets. As shown in FIGS. 7*a* and 7*b*, balls 51, attached to rollers 53, are inserted into end caps 55. Each end cap defines two sockets 57. Slits 59 are formed in the walls of the sockets, so that the walls can flex when a ball is inserted. Since the balls 51 are not compressible, they retain their original shape when inserted into the sockets. When fully inserted, the balls substantially fill the space within the sockets, just as in the embodiment described earlier.

The lower left-hand corner of FIG. 7*a* shows a ball 51 being inserted into the deformable socket. The figure shows the walls of the socket as they begin to move away from each other. As in the previous embodiment, the sockets have chamfers which guide the balls into the sockets. Also, the walls defining the slits are joined at an apex 61 which is curved, to allow the walls to spread apart without cracking, in a manner analogous to that of the previous embodiment.

In the embodiment of FIGS. 7*a*–7*e*, the "normal" position is the position wherein the walls of the socket are not spread apart, but are generally parallel to each other, as shown. For example, the end caps on the right-hand sides of FIGS. 7*a* and 7*b* are shown in the normal position. The walls tend to return to this normal position upon removal of a spreading force. Thus, when the ball is no longer in a position to hold the socket walls apart, the walls close upon the balls, creating a locking effect, similar to that of the previous embodiment. The difference between the two embodiments is in which component is deformable. In the first embodiment, the ball is deformable, while in the second embodiment, the socket is deformable. The results of the two embodiments are substantially the same.

In use, the extractor is preferably installed at or near the bottom edge of a new tube of material, and is gradually moved up along the tube as the material therein is consumed. When the extractor has reached the vicinity of the top edge of the tube, the tube is virtually empty. The extractor can then be easily removed from the old tube and re-installed on a new tube. The use of the extractor is essentially the same for either of the embodiments described above.

The extractor of the present invention can be used with virtually any tube made of a flexible material. Tubes holding medicines or toothpaste are typically made either of plastic or of a thin layer of metal or metal foil, and are therefore easily compressed by the rollers of the extractor.

Use of the extractor of the present invention not only insures that virtually all of the contents of the tube will be used, but it also keeps the tube neat and clean as it is emptied.

The invention can be further modified. The material used to make the roller assemblies and end caps can be changed. The amount of taper in the slits of the balls can be varied. These and other modifications, which will be apparent to those skilled in the art, should be considered within the spirit and scope of the following claims.

What is claimed is:

1. An extractor for emptying tubes, comprising:

a) a pair of roller assemblies, each roller assembly comprising a roller and a ball, b) a pair of end caps, each end cap defining a socket capable of receiving the ball, wherein the balls and sockets are resiliently fitted around each other.

2. The extractor of claim 1, wherein the ball includes two sections which define a slit disposed between said sections, wherein the ball has a center, and wherein the slit extends beyond the center of the ball, in a direction towards the roller.

3. The extractor of claim 2, wherein the slit includes a curved apex.

4. The extractor of claim 1, wherein the socket includes a chamfer having a size capable of guiding the ball into the socket.

5. The extractor of claim 1, wherein the balls comprise truncated spheres, and wherein the balls are connected to the rollers by a neck, and wherein the socket has a shape which generally mates with the ball and the neck.

6. The extractor of claim 2, wherein the balls are made of a resilient material, wherein the sections of the balls tend to assume a position in which the slit is open.

7. The extractor of claim 1, wherein the socket includes walls made of a resilient material, wherein the walls of the socket are capable of being resiliently spread apart, and wherein the walls tend to assume a position in which the walls lock themselves around the ball when the ball is within the socket.

8. An extractor for emptying tubes, comprising:

a) a pair of roller assemblies, each roller assembly comprising a roller and a ball, b) a pair of end caps, each end cap defining a socket capable of receiving the ball, wherein the ball includes two sections which define a slit disposed between said sections, the slit having a curved apex, wherein the ball has a center, and wherein the slit extends beyond the center of the ball, in a direction towards the roller, and wherein the balls are made of a resilient material, wherein the sections of the balls tend to assume a position in which the slit is open.

9. The extractor of claim 8, wherein the socket includes a chamfer having a size capable of guiding the ball into the socket.

10. The extractor of claim 8, wherein the balls comprise truncated spheres, and wherein the balls are connected to the rollers by a neck, and wherein the socket has a shape which generally mates with the ball and the neck.

11. An extractor for emptying tubes, comprising:

a) a pair of roller assemblies, each roller assembly comprising a roller and a ball, and b) a pair of end caps, each end cap defining a socket capable of receiving the ball, wherein the ball has a center, and wherein the ball has a slit which extends beyond the center of the ball, in a direction towards the roller.

12. The extractor of claim 11, wherein the slit includes a curved apex.

13. The extractor of claim 11, wherein the socket includes a chamfer having a size capable of guiding the ball into the socket.

14. The extractor of claim 11, wherein the balls comprise truncated spheres, and wherein the balls, are connected to the rollers by a neck, and wherein the socket has a shape which generally mates with the ball and the neck.

15. The extractor of claim 11, wherein the balls are made of a resilient material, wherein the sections of the balls tend to assume a position in which the slit is open.

16. An extractor for emptying tubes, comprising:

a) a pair of roller assemblies, each roller assembly comprising a roller and a ball, b) a pair of end caps, each end cap defining a socket capable of receiving the ball, wherein each socket includes two sections which are resiliently movable relative to each other.

17. The extractor of claim 16, wherein the socket includes a chamfer having a size capable of guiding the ball into the socket.

18. The extractor of claim 16, wherein said sections comprise walls made of a resilient material, wherein the walls tend to assume a position in which the walls lock themselves around the ball when the ball is within the socket.

19. The extractor of claim 18, wherein the walls include slits which permit the walls to spread apart, and wherein the slits are joined at an apex which is curved to allow the walls to spread apart without cracking.

* * * * *